US006684952B2

(12) United States Patent
Brockman et al.

(10) Patent No.: US 6,684,952 B2
(45) **Date of Patent: *Feb. 3, 2004**

(54) INDUCTIVELY COUPLED METHOD AND APPARATUS OF COMMUNICATING WITH WELLBORE EQUIPMENT

(75) Inventors: Mark W. Brockman, Houston, TX (US); Herve Ohmer, Houston, TX (US); David L. Malone, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 42 days.

This patent is subject to a terminal disclaimer.

(21) Appl. No.: 09/859,944

(22) Filed: May 17, 2001

(65) Prior Publication Data

US 2001/0035288 A1 Nov. 1, 2001

Related U.S. Application Data

(63) Continuation-in-part of application No. 09/784,651, filed on Feb. 15, 2001, which is a continuation-in-part of application No. 09/196,495, filed on Nov. 19, 1998, now Pat. No. 6,209,648

(60) Provisional application No. 60/212,278, filed on Jun. 19, 2000.

(51) Int. Cl.[7] ..... E21B 47/12

(52) U.S. Cl. ..... 166/250.03; 166/65.1; 166/373; 166/50; 166/242.6; 340/854.8

(58) Field of Search ..... 166/244.1, 250.01, 166/250.03, 373, 50, 65.1, 66, 66.5, 242.1, 242.6; 340/854.8, 853.1, 856.3, 855.1

(56) References Cited

U.S. PATENT DOCUMENTS

| | | | | |
|---|---|---|---|---|
| 2,379,800 A | | 7/1945 | Hare | |
| 3,206,537 A | | 9/1965 | Steward | |
| 3,659,259 A | | 4/1972 | Chaney et al. | |
| 4,806,928 A | | 2/1989 | Veneruso | |
| 4,901,069 A | | 2/1990 | Veneruso | |
| 4,953,636 A | | 9/1990 | Mohn | |
| 5,008,664 A | * | 4/1991 | More et al. | 340/854.8 |
| 5,353,876 A | | 10/1994 | Curington et al. | |
| 5,388,648 A | | 2/1995 | Jordan, Jr. | |
| 5,455,573 A | | 10/1995 | Delatorre | |
| 5,542,472 A | * | 8/1996 | Pringle et al. | 166/65.1 |
| 5,831,156 A | | 11/1998 | Mullins | |
| 5,875,847 A | | 3/1999 | Forsyth | |
| 5,915,474 A | | 6/1999 | Buytaert et al. | |
| 5,918,669 A | | 7/1999 | Morris et al. | |
| 5,944,107 A | | 8/1999 | Ohmer | |
| 5,945,923 A | | 8/1999 | Soulier | |
| 5,954,134 A | | 9/1999 | Longbottom | |
| 5,959,547 A | * | 9/1999 | Tubel et al. | 340/853.2 |
| 6,003,606 A | * | 12/1999 | Moore et al. | 166/381 |
| 6,061,000 A | | 5/2000 | Edwards | |
| 6,286,595 B1 | | 9/2001 | Oxnevad et al. | |
| 6,302,203 B1 | * | 10/2001 | Rayssiguier et al. | 166/250.01 |
| 2001/0013410 A1 | | 8/2001 | Beck et al. | |

FOREIGN PATENT DOCUMENTS

| | | |
|---|---|---|
| EP | 0 795 679 | 9/1997 |
| EP | 0 823 534 | 2/1998 |
| WO | WO 98/58151 | 12/1998 |
| WO | WO 99/13195 | 3/1999 |

* cited by examiner

*Primary Examiner*—Heather Shackelford
*Assistant Examiner*—John Kreck
(74) *Attorney, Agent, or Firm*—Trop, Pruner & Hu, P.C.; Jeffrey E. Griffin; Brigitte Jeffery Echols

(57) ABSTRACT

A method and apparatus that allows communications of electrical power and signaling from downhole component to another downhole component employs an inductive coupler assembly. In one arrangement, one portion of the inductive coupler assembly is attached to a production tubing section and the other portion of the inductive coupler assembly is attached to a casing or other liner section. The production tubing inductive coupler portion is electrically connected to a cable over which electrical power and signals may be transmitted. Such power and signals are magnetically coupled to the inductive coupler portion in the casing or liner section and communicated to various electrical devices mounted outside the casing or liner section. In other arrangements, inductive coupler assemblies may be used to couple electrical power and signals from the main bore to components in lateral branches of a multilateral well.

18 Claims, 12 Drawing Sheets

INDUCTIVELY COUPLED METHOD AND APPARATUS OF COMMUNICATING WITH WELLBORE EQUIPMENT

CROSS REFERENCE TO RELATED APPLICATION

This is a continuation-in-part of U.S. Ser. No. 09/784,651, filed Feb. 15, 2001, which claims the benefit under 35 U.S.C. §119(e) of U.S. Provisional Application Ser. No. 60/212,278, filed Jun. 19, 2000, and which is a continuation-in-part of U.S. Ser. No. 09/196,495, filed Nov. 19, 1998 now U.S. Pat. No. 6,209,648.

BACKGROUND

The invention relates to an inductively coupled method and apparatus of communicating with wellbore equipment.

A major goal in the operation of a well is improved productivity of the well. The production of well fluids may be affected by various downhole conditions, such as the presence of water, pressure and temperature conditions, fluid flow rates, formation and fluid properties, and other conditions. Various monitoring devices may be placed downhole to measure or sense for these conditions. In addition, control devices, such as flow control devices, may be used to regulate or control the well. For example, flow control devices can regulate fluid flow into or out of a reservoir. The monitoring and control devices may be part of an intelligent completion system (ICS) or a permanent monitoring system (PMS), in which communications can occur between downhole devices and a well surface controller. The downhole devices that are part of such systems are placed in the well during the completion phase with the expectation that they will remain functional for a relatively long period of time (e.g., many years).

To retrieve information gathered by downhole monitoring devices and/or to control activation of downhole control devices, electrical power and signals may be communicated down electrical cables from the surface. However, in some locations of the well, it may be difficult to reliably connect electrical conductors to devices due to the presence of water and other well fluids. One such location is in a lateral branch of a multilateral well. Typically, completion equipment in a lateral branch is installed separately from the equipment in the main bore. Thus, any electrical connection that needs to be made to the equipment in the lateral branch would be a "wet" connection due to the presence of water and other liquids.

In addition, because of the presence of certain completion components, making an electrical connection may be difficult and impractical. Furthermore, the hydraulic integrity of portions of the well may be endangered by such connections. One example involves sensors, such as resistivity electrodes, that are placed outside the casing to measure the resistivity profile of the surrounding formation. Electrical cables are typically run within the casing, and making an electrical connection through the casing is undesirable. Resistivity electrodes may be used to monitor for the presence of water behind a hydrocarbon-bearing reservoir. As the hydrocarbons are produced, the water may start advancing toward the wellbore. At some point, water may be produced into the wellbore. Resistivity electrodes provide measurements that allow a well operator to determine when water is about to be produced so that corrective action may be taken.

However, without the availability of cost effective and reliable mechanisms to communicate electrical power and signaling with downhole monitoring and control devices, the use of such devices to improve the productivity of a well may be ineffective. Thus, a need exists for an improved method and apparatus for communicating electrical power and/or signaling with downhole modules.

SUMMARY

In general, according to one embodiment, an apparatus for use in a wellbore portion having a liner includes an electrical device attached outside the liner and electrically connected to the electrical device. A second inductive coupler portion is positioned inside the liner to communicate an electrical signaling with the first inductive coupler portion.

In general, according to another embodiment, an apparatus for use in a well having a main bore and a lateral branch having an electrical device includes an inductive coupler mechanism to electrically communicate electrical signaling in the main bore with the electrical device in the lateral branch.

Other features and embodiments will become apparent from the following description, the drawings, and the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

In accordance with some embodiments, inductive couplers are used to communicate electrical power and signaling to devices in a wellbore. Such devices may include monitoring devices, such as sensors, placed outside casing or another type of liner to measure the resistivity or other characteristic of the surrounding formation. Other types of monitoring devices include pressure and temperature sensors, sensors to detect stress experienced by completion components (such as strain gauges), and other monitoring devices to monitor for other types of seismic, environmental, mechanical, electrical, chemical, and any other conditions. Stress recorders may also be located at a junction between a main wellbore and a lateral branch. Such stress recorders are used to monitor the stress of a junction that is predeformed and expanded by a hydraulic jack once positioned downhole. The stress due to the expansion operation is monitored to ensure structural integrity can be maintained. Electrical power and signaling may also be communicated to control devices that control various components, such as valves, monitoring devices, and so forth. By using inductive couplers, wired connections can be avoided to certain downhole monitoring and/or control devices. Such wired connections may be undesirable due to presence of well fluids and/or downhole components.

In accordance with some embodiments, electrical devices and a portion of an inductive coupler may be assembled as part of a completion string module, such as a section of casing, liner, or other completion equipment. This provides a more modular implementation to facilitate the installation of monitoring and/or control devices in a wellbore.

In accordance with a further embodiment, inductive couplers may be used to couple electrical power and signaling between components in a main bore and components in a lateral branch of a multilateral well. In one arrangement, inductive couplers may be assembled as part of a connector mechanism used to connect lateral branch equipment to main bore equipment.

Figure 1A:
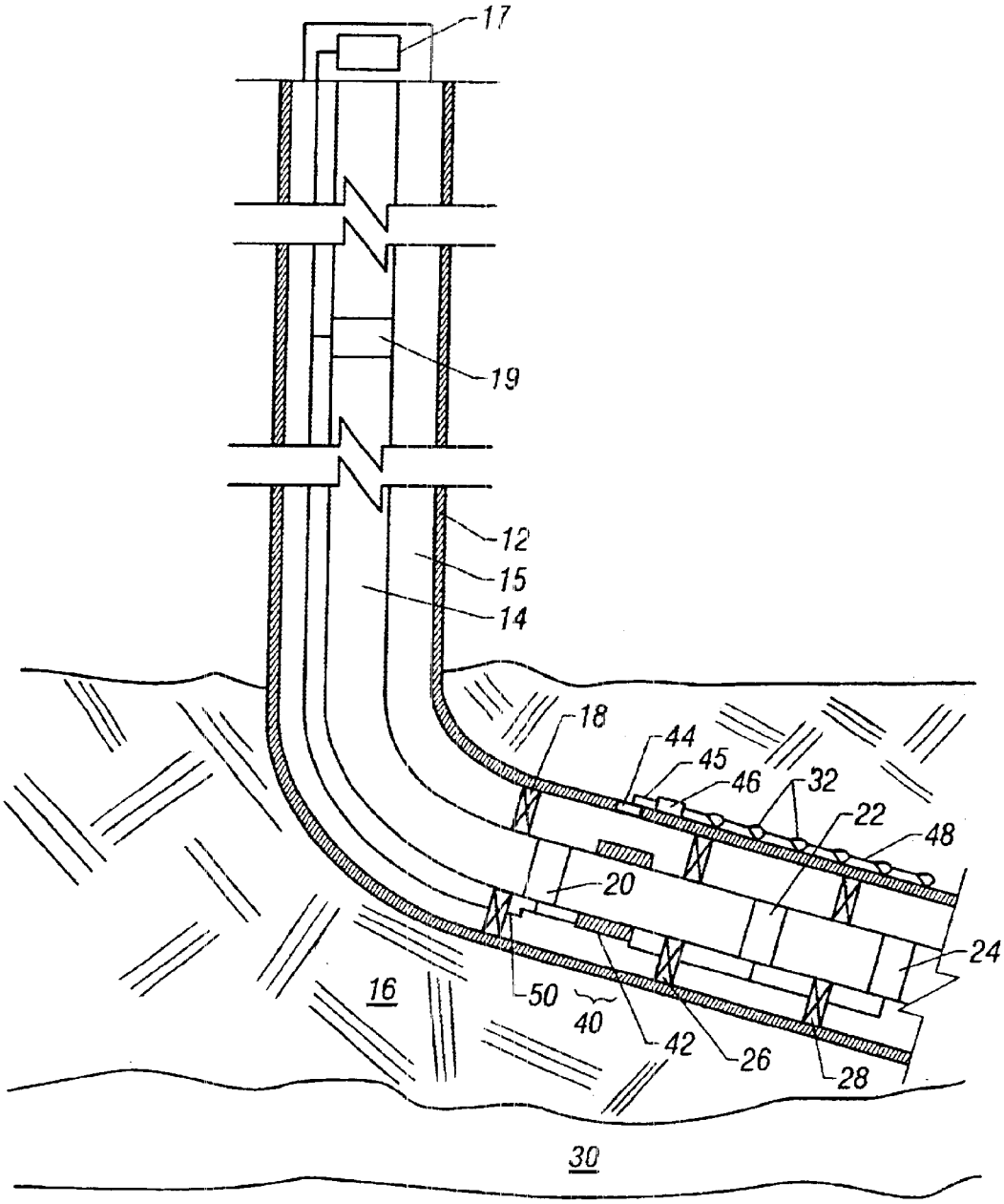
FIG. 1A illustrates an embodiment of a completion string including electrical devices and an inductive coupler assembly to communicate electrical power and signaling to the electrical devices.

Referring to FIG. 1A, a completion string according to one embodiment is positioned in a well, which may be a vertical, horizontal, or deviated wellbore, or a multilateral well. The completion string includes casing 12 lining a wellbore 10 and production tubing 14 placed inside the casing 12 that extends to a formation 16 containing hydrocarbons. A packer 18 may be used to isolate the casing-tubing annulus 15 from the portion of the wellbore below the packer 18. Although reference is made to casing in this discussion, other embodiments may include other types of liners that may be employed in a wellbore section. A liner may also include a tubing that is expandable to be used as a liner.

One or more flow control devices 20, 22, and 24 may be attached to the production tubing 14 to control fluid flow into the production tubing 14 from respective zones in the formation 16. The several zones are separated by packers 18, 26, and 28. The flow control devices 20, 22, and 24 may be independently activated. Each flow control device may include any one of various types of valves, including sliding sleeve valves, disk valves, and other types of valves. Examples of disk valves are described in U.S. patent application Ser. No. 09/243,401, entitled "Valves for Use in Wells," filed Feb. 1, 1999; and U.S. patent application Ser. No. 09/325,474, entitled "Apparatus and Method for Controlling Fluid Flow in a Wellbore," filed Jun. 3, 1999, both having common assignee as the present application and hereby incorporated by reference.

Each flow control device 20, 22, or 24 may be an on/off device (that is, actuatable between open or closed positions). In further embodiments, each flow control device may also be actuatable to at least an intermediate position between the open and closed positions. An intermediate position refers to a partially open position that may be set at some percentage of the fully open position. As used here, a "closed" position does not necessarily mean that all fluid flow is blocked. There may be some leakage, with a flow of about 6% or less of a fully open flow rate being acceptable in some applications.

During production, the illustrated flow control devices 20, 22, and 24 may be in the open position or some intermediate position to control production fluid flow from respective zones into the production tubing 14. However, under certain conditions, fluid flow through the flow control devices 20, 22, and 24 may need to be reduced or shut off. One example is when one zone starts producing water. In that case, the flow control device associated with the water-producing zone may be closed to prevent production of water.

One problem that may be encountered in a formation is the presence of a layer of water (e.g., water layer 30) behind a reservoir of hydrocarbons. As hydrocarbons are produced, the water level may start advancing towards the wellbore. One zone may start producing water earlier than another zone. To monitor for the advancing layer of water 30, sensors 32 (e.g., resistivity electrodes) may be used. As illustrated, the resistivity electrodes 32 may be arranged along a length of a portion of the casing 12 to monitor the resistivity profile of the surrounding formation 16. As the water layer advances, the resistivity profile may change. At some point before water actually is produced with hydrocarbons, one or more of the flow control devices 20, 22, and 24 may be closed. The remaining flow control devices may remain open to allow continued production of hydrocarbons.

Typically, the resistivity electrodes 32 are placed outside a section of the casing 12 or some other type of liner. As used here, a "casing section" or "liner section" may refer to an integral segment of a casing or liner or to separate piece attached to the casing or liner. The casing or liner section has an inner surface (defining a bore in which completion equipment may be placed) and an outer surface (typically cemented or otherwise affixed to the wall of the wellbore). Devices mounted on, or positioned, outside of the casing or liner section are attached, either directly or indirectly, to the outer surface of the casing or liner section. Devices are also said to be mounted on or positioned outside the casing or liner section if they are mounted or positioned in a cavity, chamber, or conduit defined in the housing of the casing or liner section. A device positioned inside the casing or liner section is placed within the inner surface of the casing or liner section.

In the illustrated embodiment of FIG. 1A, the electrodes 32 may be coupled to a sensor control module 46 by an electrical line 48. The sensor control module 46 may be in the form of a circuit board having control and storage units (e.g., integrated circuit devices). Forming a wired connection from an electrical cable inside the casing section to the electrodes 32 and control module 46 outside the casing section may be difficult, impractical, and unreliable. In accordance with some embodiments, to provide electrical power and to communicate signaling to the electrodes 32 and the control module 46, an inductive coupler assembly 40 is used. The inductive coupler assembly 40 includes an inner portion attached to a section of the production tubing 14 or other completion component and an outer portion 44 attached to the casing section. The outer inductive coupler portion 44 may be coupled by an electrical link 45 to the control module 46. The inner inductive coupler portion 42 is connected to an electrical cable 50, which may extend to a power source and surface controller 17 located at the well surface or to a power source and controller 19 located somewhere in the wellbore 10. For example, in an intelligent completion system (ICS), power sources and controllers may be included in downhole modules. The controllers 17 and 19 may each provide a power and telemetry source.

The electrical cable 50 may also be connected to the flow control devices 20, 22, and 24 to control actuation of those devices. The electrical cable 50 may extend through a conduit in the housing of the production tubing 14, or the cable 50 may run outside the tubing 14 in the casing-tubing annulus. In the latter case, the cable 50 may be routed through packer devices, such as packer devices 18, 26, and 28.

Some type of addressing scheme may be used to selectively access one or more of the flow control devices 20, 22, and 24 and the sensor control module 46 coupled to the electrodes 32. Each of the components downhole may be assigned a unique address such that only selected one or ones of the components, including the flow control devices 20, 22, and 24 and the sensor module 46, are activated.

Figure 1B:
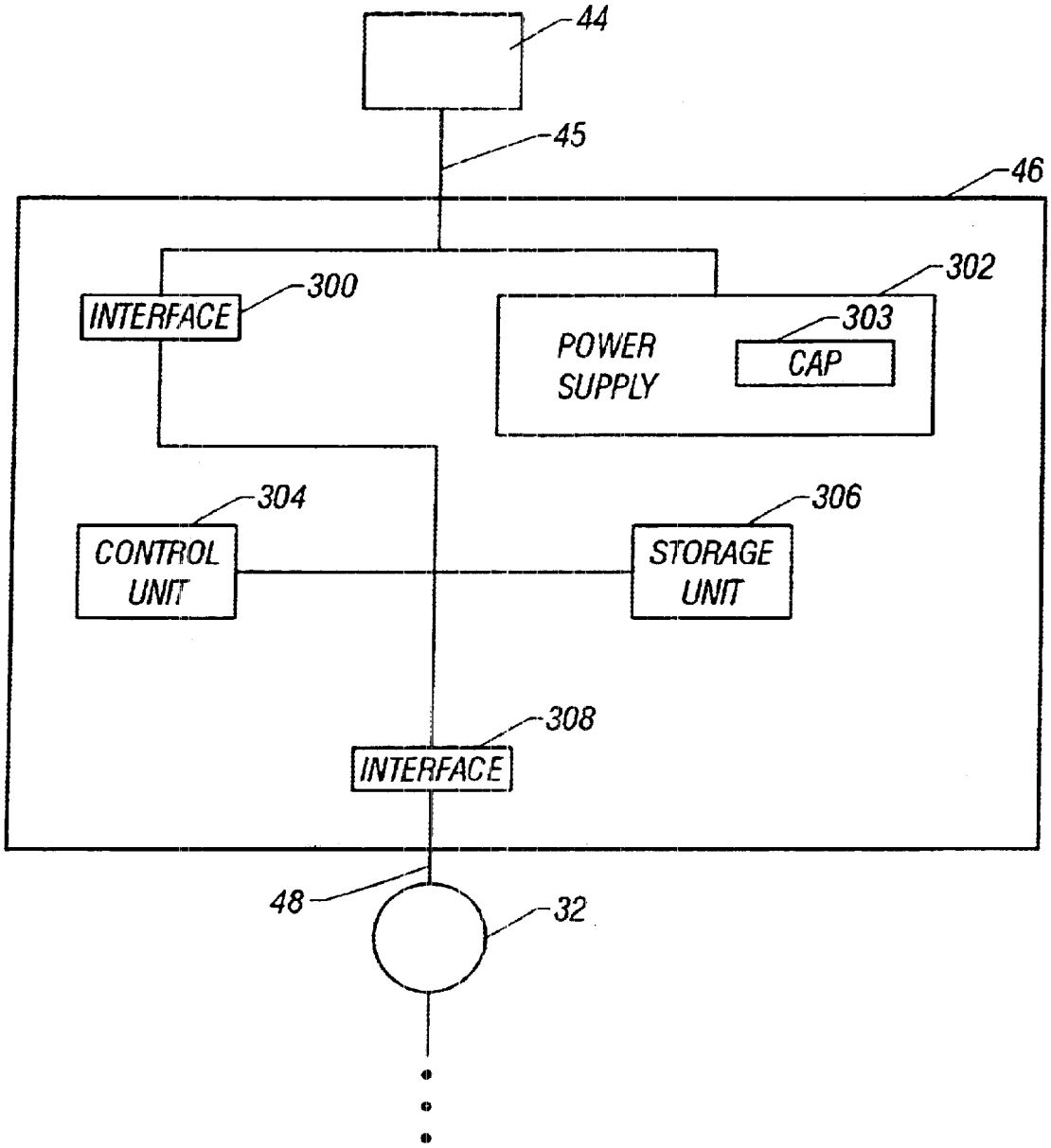
FIG. 1B illustrates an example of a control module that is part of the electrical devices of FIG. 1A.

To activate the sensor control module 46, power and appropriate signals are sent down the cable 50 to the inner inductive coupler portion 42. The power and signals are inductively coupled from the inner inductive coupler portion 42 to the outer inductive coupler portion 44. Referring to FIG. 1B, the outer inductive coupler portion 44 communicates the electrical power to the control module 46, which includes a first interface 300 coupled to the link 45 to the inductive coupler portion 44. A power supply 302 may also be included in the control module 46. The power supply 302 may include a local battery or it may be powered by electrical energy communicated to the outer inductive coupler portion 44. A control unit 304 in the control module 46 is capable of decoding signals received by the inductive coupler portion 44 to activate an interface 308 coupled to the link 48 to the electrodes 32. The control unit 304 may include a microcontroller, microprocessor, programmable array logic, or other programmable device. The measured signals from the electrodes 32 are received by the sensor control module 46 and communicated to the outer inductive coupler portion 44. The received data is coupled from the outer inductive coupler portion 44 to the inner inductive coupler portion 42, which in turn communicates the signals up the electrical cable 50 to the surface controller 17 or to the downhole controller 19. The resistivity measurements made by the electrodes 32 are then processed either by the surface controller 17 or downhole controller 19 to determine if conditions in the formation are such that one or more of the flow control devices 20, 22, and 24 need to be shut off.

The sensor control module 46, provided that it has some form of power (either in the form of a local battery or power inductively coupled through the inductive coupler assembly 40) may also periodically (e.g., once a day, once a week, etc.) activate the electrodes 32 to make measurements and store those measurements in a local storage unit 306, such as a non-volatile memory (EPROM, EEPROM, or flash memory) or a memory such as a dynamic random access memory (DRAM) or static random access memory (SRAM). In a subsequent access of the sensor control module 46 over the electrical cable 50, the contents of the storage unit 306 may be communicated through the inductive coupler assembly 40 to the electrical cable 50 for communication to the surface controller 17 or downhole controller 19.

In one embodiment, power to the control module 46 and electrodes 32 may be provided by a capacitor 303 in the power supply 302 that is trickle-charged through the inductive coupler assembly 40. Electrical energy in the electrical cable 50 may be used to charge the capacitor 302 over some extended period of time. The charge in the capacitor 302 may then be used by the control unit 304 to activate the electrodes 32 to make measurements. If the coupling efficiency of the inductive coupler assembly 40 is relatively poor, then such a trickle-charge technique may be effective in generating the power needed to activate the electrodes 32.

Figure 2A:
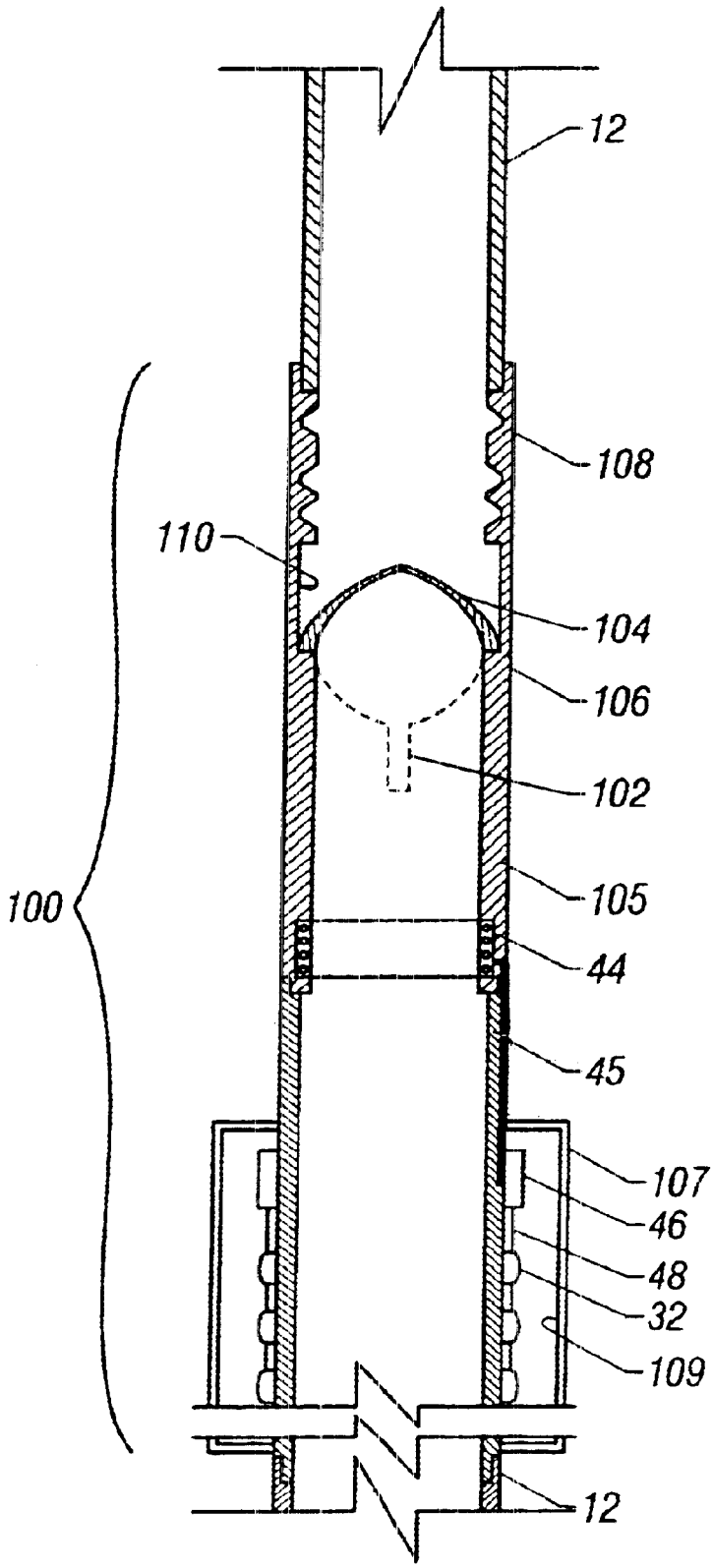
FIG. 2A is a cross-sectional view of a casing coupling module connected to casing sections in the completion string of FIG. 1A, the casing coupling module including a first portion of the inductive coupler assembly, sensors, and a control module in accordance with an embodiment.
Figure 2B:
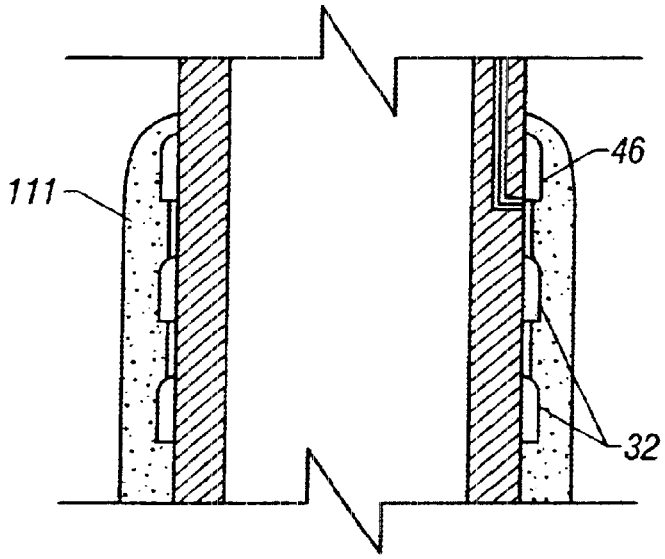
FIG. 2B illustrates a portion of a casing coupling module in accordance with another embodiment.

Referring to FIG. 2A, a casing coupling module 100 is illustrated. The casing coupling module 100 is adapted to be attached to the well casing 12, such as by threaded connections. The sensor control module 46 and electrodes 32 may be mounted on the outer wall 106 of (or alternatively, to a recess in) the casing module housing 105. A protective sleeve 107 may be attached to the outer wall of the casing coupling module 100 to protect the control module 46 and electrodes 32 from damage when the casing coupling module 100 is run into the wellbore. In an alternative arrangement, the control module 46 and/or the electrodes 32 may be mounted to the inner wall 109 of the protective sleeve 107. If the electrodes 32 are resistivity electrodes, then the sleeve 107 may be formed of a non-conductive material. With other types of electrodes, conductive materials such as steel may be used. In yet further embodiments, as shown in FIG. 2B, instead of a sleeve, a layer of coating 111 may be formed around the devices 32 and 46.

The outer inductive coupler portion 44 may be mounted in a cavity of the housing 105 of the casing coupling module 100. Effectively, the casing coupling module 100 is a casing section that includes electrical control and/or monitoring devices. The casing coupling module 100 provides for convenient installation of the inductive coupler portion 44, control module 46, and electrodes 32. The module 100 may also be referred to as a liner coupling module if used with other types of liners, such as those found in lateral branch bores and other sections of a well. The inner diameter of the casing or liner coupling module 100 may be substantially the same as or greater than the inner diameter of the casing or liner to which it is attached. In further embodiments, the casing or liner coupling module 100 may have a smaller inner diameter.

A landing profile 108 is provided in the inner wall 110 of the housing 105 of the casing coupling module 100. The landing profile 108 is adapted to engage a corresponding member in completion equipment adapted to be positioned in the casing coupling module 100. One example of such completion equipment is a section of the production tubing 14 to which the inner inductive coupler portion 42 is attached. The section of the tubing 14 (or of some other completion equipment) that is adapted to be engaged in the casing coupling module 100 may be referred to as a landing adapter.

The casing coupling module 100 further includes an orienting ramp 104 and an orientation profile 102 to orient the landing adapter inside the casing coupling module 100. Landing and orientation keys on the landing adapter are engaged to the landing profile 108 and orientation profile 102, respectively, of the casing coupling module.

In other embodiments, other types of orienting and locator mechanisms may be employed. For example, another type of locator mechanism may include an inductive coupler assembly. An inductive coupler portion having a predetermined signature (e.g., generated output signal having predetermined frequency) may be employed. When completion equipment are lowered into the wellbore into the proximity of the locator mechanism, the predetermined signature is received and the correct location can be determined. Such a locator mechanism avoids the need for mechanical profiles that may cause downhole devices to get stuck.

Figure 3:
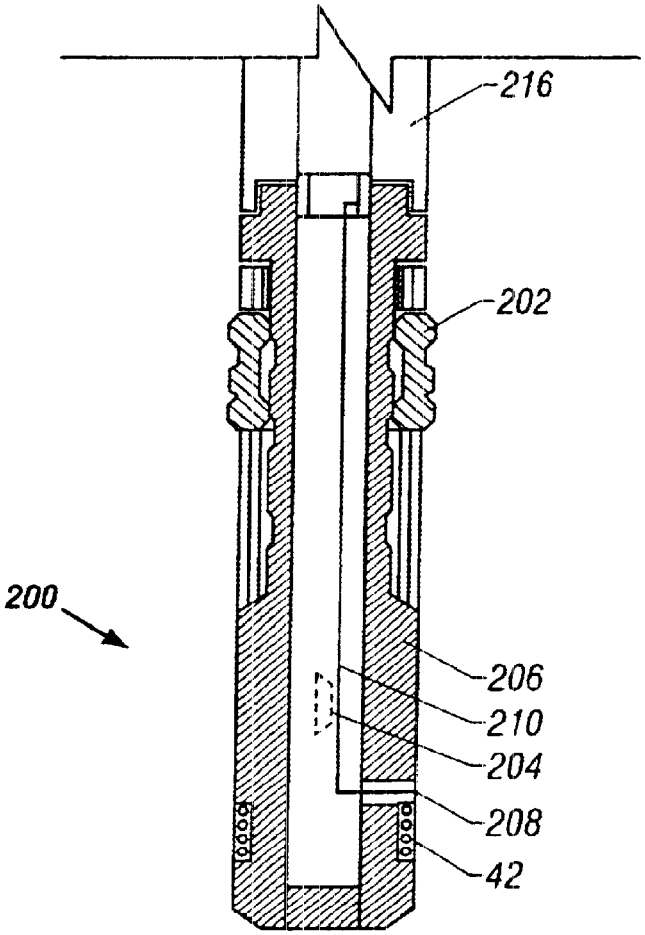
FIG. 3 is a cross-sectional view of a landing adapter in accordance with an embodiment including landing and orientation keys to engage profiles in the casing coupling module of FIG. 2, the landing adapter further comprising a second portion of the inductive coupler assembly to electrically communicate with the first inductive coupler portion of the casing coupling module.

Referring to FIG. 3, a landing adapter 200 for engaging the inside of the casing coupling module 100 of FIG. 2 is illustrated. The landing adapter 200 includes landing keys 202 and an orientation key 204. The inner inductive coupler portion 42 may be mounted in a cavity of the housing 206 of the landing adapter 200 electrically connected to driver circuitry 208 to electrically communicate with one or more electrical lines 210 in the landing adapter 200. Although shown as extending inside the inner bore 212 of the landing adapter 200, an alternative embodiment may have the one or more electrical lines 210 extending through conduits formed in the housing 206 or outside the housing 206. The one or more electrical lines 210 are connected to electronic circuitry 216 attached to the landing adapter 200. The electronic circuitry 216 may in turn be connected to the electrical cable 50 (FIG. 1).

Figure 4:
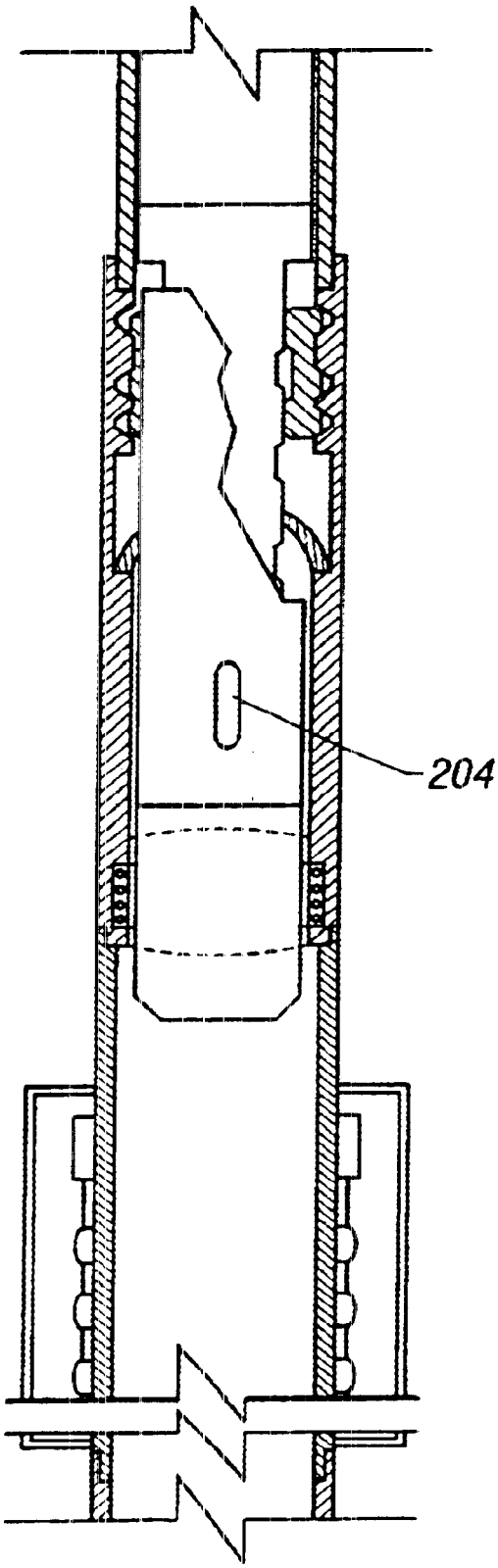
FIG. 4 is an assembled view of the landing adapter of FIG. 3 and the casing coupling module of FIG. 2 in accordance with one embodiment.

Referring to FIG. 4, the landing adapter 200 is shown positioned and engaged inside the casing coupling module 100. The orienting ramp 104 and orienting profile 102 of the casing coupling member 100 and the orienting key 204 of the landing adapter 200 are adapted to orient the adapter 200 to a desired azimuthal relationship inside the casing coupling module 100. In another embodiment, the orienting mechanisms in the landing adapter 200 and the casing coupling module 100 may be omitted. In the engaged position, the inner inductive coupler portion 42 attached to the landing adapter 200 and the outer inductive coupler portion 44 attached to the casing coupling module 100 are in close proximity so that electrical power and signaling may be inductively coupled between the inductive coupler portions 42 and 44.

In operation, a lower part of the casing 12 (FIG. 2) may first be installed in the wellbore 10. Following installation of the lower casing portion, the casing coupling module 100 may be lowered and connected to the lower casing portion. Next, the remaining portions of the casing 12 may be installed in the wellbore 10. Following installation of the casing 12, the rest of the completion string may be installed, including the production tubing, packers, flow control devices, pipes, anchors, and so forth. The production tubing 14 is run into the wellbore 10 with the integrally or separately attached landing adapter 200 at a predetermined location along the tubing 14. When the landing adapter 200 is engaged in the casing coupling module 100, electrical power and signaling may be communicated down the cable 50 to activate the sensor control module 46 and electrodes 32 to collect resistivity information.

In further embodiments, other inductive coupler assemblies similar to the inductive coupler assembly 40 may be used to communicate electrical power and signaling to other control and monitoring devices located elsewhere in the well.

Figure 6:
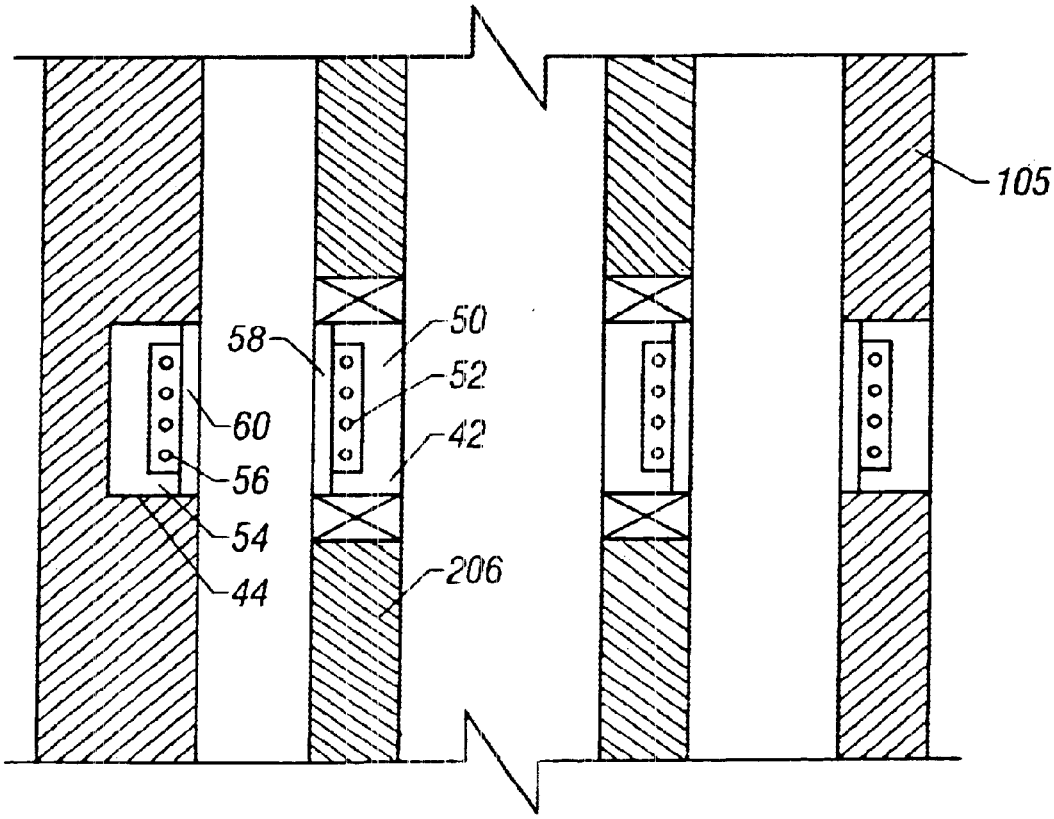
FIG. 6 illustrates an embodiment of an inductive coupler assembly.

Referring to FIG. 6, the inductive coupler assembly 40 according to one embodiment is shown in greater detail. The inner inductive coupler portion 42 includes an inner coil 52 that surrounds an inner core 50. The outer inductive coupler portion 44 includes an outer core 50 that encloses an outer coil 56. According to one embodiment, the cores 50 and 54 may be formed of any material that has a magnetic permeability greater than that of air and an electrical resistivity greater than that of solid iron. One such material may be a ferrite material including ceramic magnetic materials formed of ionic crystals and having the general chemical composition MeFe203, where Me is selected from the group consisting of manganese, nickel, zinc, magnesium, cadmium, cobalt, and copper. Other materials forming the core may be iron-based magnetic alloy materials that have the required magnetic permeability greater than that of air and that have been formed to create a core that exhibits the electrical resistivity greater than that of solid iron.

The inner coil 52 may include a multi-turn winding of a suitable conductor or insulated wire wound in one or more layers of uniform diameter around the mid-portion of the core 50. A tubular shield 58 formed of a non-magnetic material may be disposed around the inner inductive coupler portion 42. The material used for the shield 58 may include an electrically-conductive metal such as aluminum, stainless steel, or brass arranged in a fashion as to not short circuit the inductive coupling between inductive coupler portions 42 and 44. The outer coil 56 similarly includes a multi-turn winding of an insulated conductor or wire arranged in one or more layers of uniform diameter inside of the tubular core 54. Although electrical insulation is not required, the outer inductive coupler portion 44 may be secured to the casing housing 105 by some electrically insulating mechanism, such as a non-conductive potting compound. A protective sleeve 60 may be used to protect the outer inductive coupler portion 44. The protective sleeve 60 may be formed of a non-magnetic material similar to the shield 58.

Further description of some embodiments of the inductive coupler portions 42 and 44 may be found in U.S. Pat. No.

4,901,069, entitled "Apparatus for Electromagnetically Coupling Power and Data Signals Between a First Unit and a Second Unit and in Particular Between Well Bore Apparatus and the Surface," issued Feb. 13, 1990; and U.S. Pat. No. 4,806,928, entitled "Apparatus for Electromagnetically coupling Power and Data Signals Between Well Bore Apparatus and the Surface," issued Feb. 21, 1989, both having common assignee as the present application and hereby incorporated by reference.

To couple electrical energy between the inductive coupler portions 42 and 44, an electrical current (alternating current or AC) may be placed on the windings of one of the two coils 52 and 56 (the primary coil), which generates a magnetic field that is coupled to the other coil (the secondary coil). The magnetic field is converted to an AC current that flows out of the secondary coil. The advantage of the inductive coupling is that there is no requirement for a conductive path from the primary to secondary coil. For enhanced efficiency, it may be desirable that the medium between the two coils 52 and 56 have good magnetic properties. However, the inductive coupler assembly 40 is capable of transmitting power and signals across any medium (e.g., air, vacuum, fluid) with reduced efficiency. The amount of power and data rate that can be transmitted by the inductive coupler assembly 40 may be limited, but the typically long data collection periods of the downhole application permits a relatively low rate of power consumption and requires a relatively low data rate.

Figure 5:
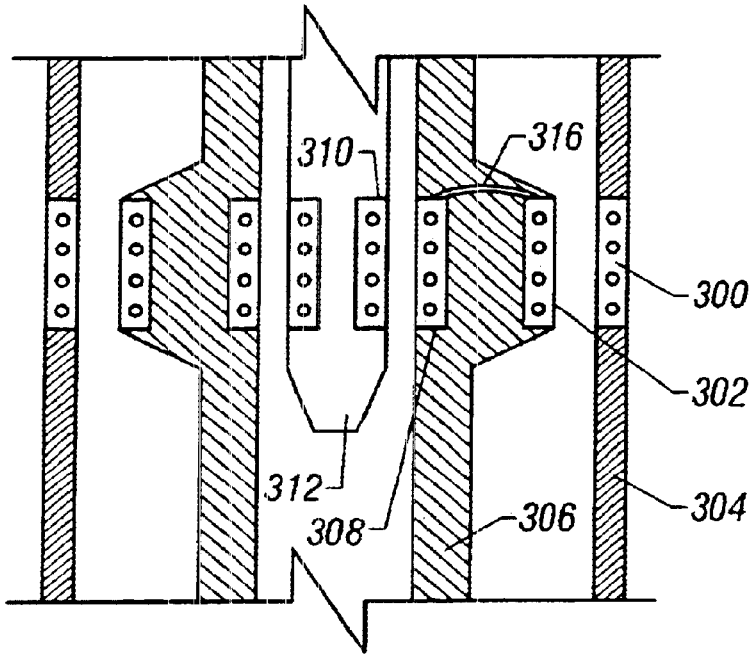
FIG. 5 illustrates an inductive coupler assembly in accordance with another embodiment to communicate electrical power and signaling to electrical devices placed outside a liner section.

Referring to FIG. 5, according to another embodiment, multiple layers may be present between the outer-most inductive coupler portion and the inner-most inductive coupler portion. As shown in FIG. 5, the outer-most inductive coupler portion 300 may be located outside or part of a casing or liner 304. A section of a tubing or pipe 306 (e.g., production tubing) may include a first inductive coupler portion 302 adapted to cooperate with the inductive coupler portion 300. A second inductive coupler portion 308 may also be integrated into the inner diameter of the tubing or pipe 306 for coupling to an innermost inductive coupler portion 310 that may be located in a tool 312 located in the bore of the tubing or pipe 306. The tool 312 may be, for example, a diagnostic tool that is lowered on a wireline, slickline, or tubing into the well for periodic monitoring of certain sections of the well. The inductive coupler portions 302 and 308 in the housing of the tubing 306 may be electrically connected by conductor(s) 316. The multi-layered inductive coupler mechanism may also be employed to communicate with other downhole devices.

A method and apparatus has been defined that allows communications of electrical power and signaling from one downhole component to another downhole component without the use of wired connections. In one embodiment, the first component is an inductive coupler portion attached to a production tubing section and the second component is another inductive coupler portion attached to a casing section. The production tubing inductive coupler portion is electrically connected to a cable over which electrical power and signals may be transmitted. Such power and signals are magnetically coupled to the inductive coupler portion in the casing section and communicated to various electrical devices mounted on the outside of the casing section.

In another embodiment, an inductive coupler assembly may also be used to connect electrical power and signals from the main bore to components in a lateral branch of a multilateral well. Referring to FIGS. 7–13, placement of a lateral branch junction connection assembly shown generally as 400 within the main casing 412 is shown. The lateral branch junction connection assembly 400 includes two basic components, a lateral branch template 418 and a lateral branch connector 428, which have sufficient structural integrity to withstand the forces of formation shifting. The assembled lateral branch junction also has the capability of isolating the production flow passages of both the main and branch bores from ingress of formation solids.

Figure 7:
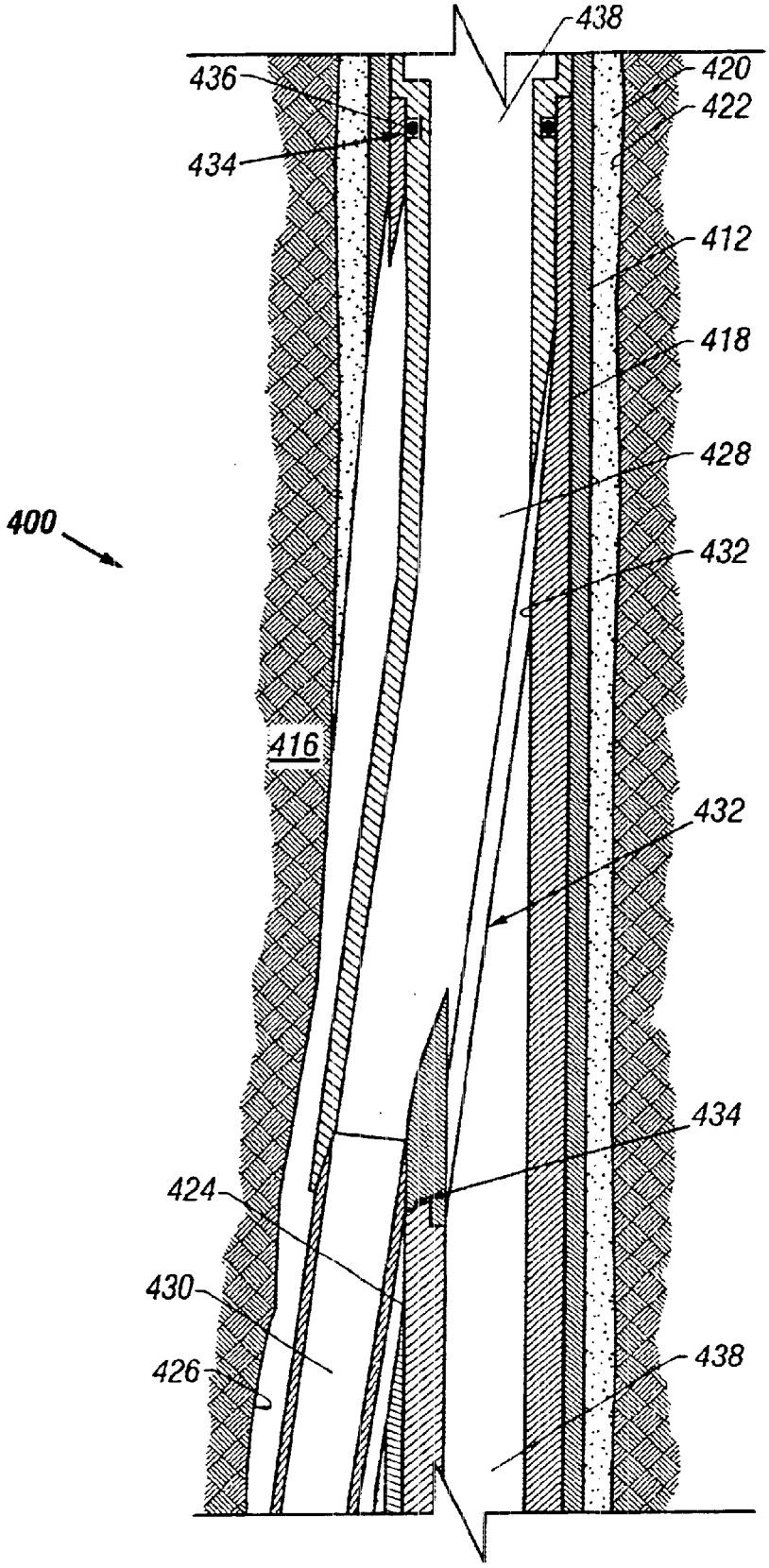
FIG. 7 is a sectional view showing an embodiment of completion equipment for use in a well having a main bore and at least one lateral branch.
Figure 8:
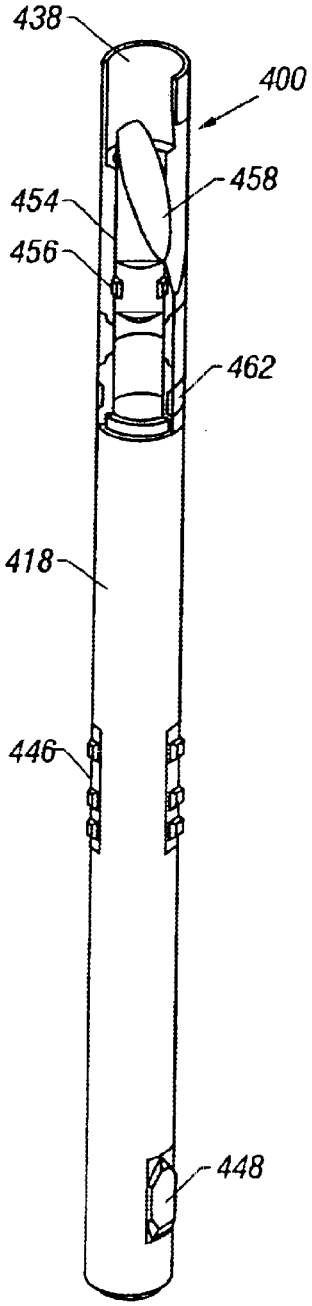
FIG. 8 is a perspective view in partial section of a lateral branch template in accordance with an embodiment having an upper portion cut away to show positioning of a diverter member within the upper portion of the template.
Figure 10:
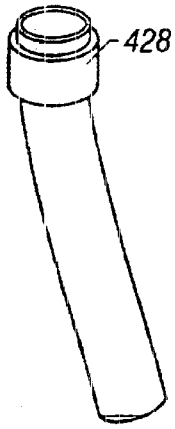
FIG. 10 is a perspective view of the liner connector member of FIG. 9.
Figure 11:
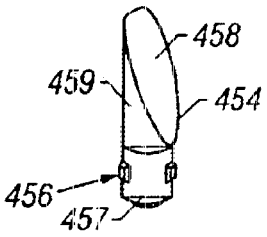
FIG. 11 is a perspective view showing the diverter member of FIG. 8 or 9.
Figure 9:
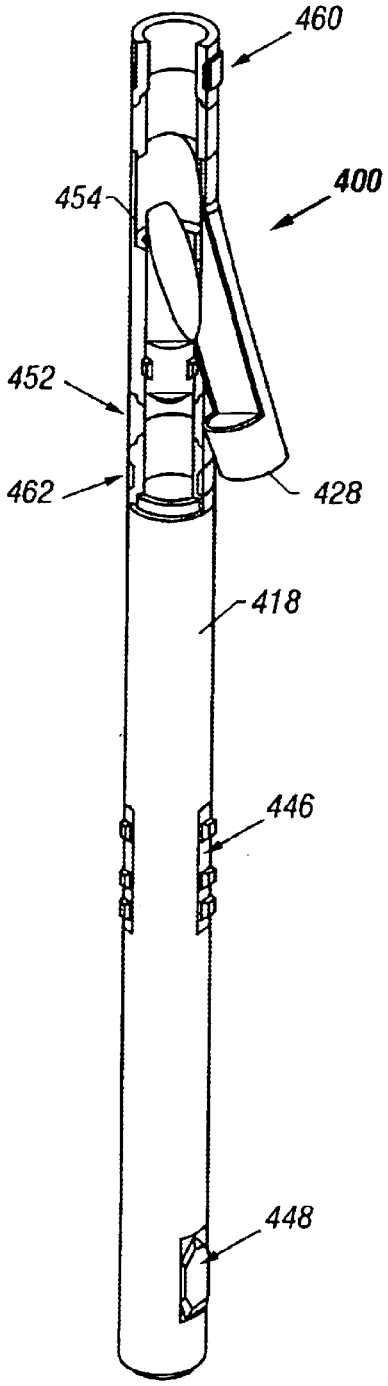
FIG. 9 is a perspective view similar to that of FIG. 8 and further showing a liner connector member and isolation packers in assembly with the lateral branch template.

As shown in FIG. 7, after the main wellbore 422 and one or more lateral branches have been constructed, a lateral branch template 418 is set at a desired location within the main well casing 412. A window 424 is formed within the main well casing 412 for each lateral branch, which may be milled prior to running and cementing of the casing 412 within the wellbore or milled downhole after the casing 12 has been run and cemented. A lateral branch bore 426 may be drilled by a branch drilling tool that is diverted from the main wellbore 422 through the casing window 424 and outwardly into the earth formation 416 surrounding the main wellbore 422. The lateral branch bore 426 is drilled along an inclination set by a whipstock or other suitable drill orientation mechanism.

The lateral branch connector 428 is attached to a lateral branch liner 430 that connects the lateral branch bore 426 to the main wellbore 422. The lateral branch connector 428 establishes fluid connectivity with both the main wellbore 422 and the lateral branch 426.

Figure 12:
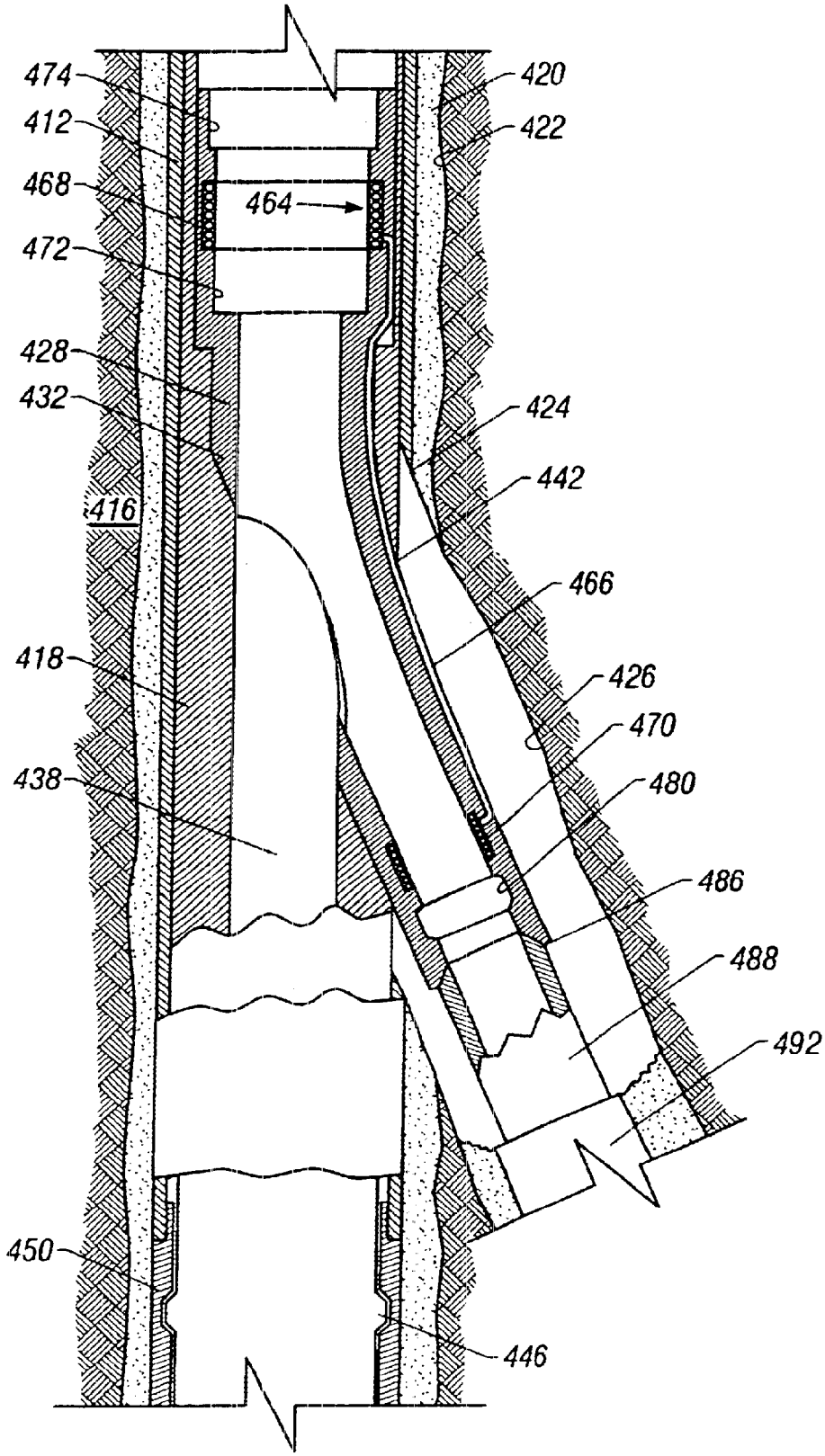
FIG. 12 is a fragmentary sectional view showing part of the completion equipment of FIG. 7 including a main casing in a main bore, the lateral branch template of FIG. 8, a casing coupling module, a lateral branch liner diverted through a window in the main casing, and inductive coupler portions in accordance with an embodiment.

As shown in FIGS. 7 and 12, a generally defined ramp 432 cut at a shallow angle in the lateral branch template 418 serves to guide the lateral branch connector 428 toward the casing window 424 while it slides downwardly along the lateral branch template 418. Optional seals 434, which may be carried within the optional seal grooves 436 on the lateral branch connector 428, establish sealing between the lateral branch template 418 and the lateral branch connector 428 to ensure hydraulic isolation of the main and lateral branch bores from the environment externally thereof. A main production bore 438 is defined when the lateral branch connector 428 is fully engaged with the guiding and interlocking features of the lateral branch template 418.

Interengaging retainer components (not shown in FIG. 7) located in the lateral branch template 418 and the lateral branch connector 428 prevent the lateral branch connector 428 from disengaging from its interlocking and sealed position with respect to the lateral branch template 418.

FIGS. 8–11 collectively illustrate the lateral branch junction connection assembly 400 by means of isometric illustrations having parts thereof broken away and shown in section. The lateral branch template 418 supports positioning keys 446 and an orienting key 448 that mate respectively with positioning and orienting profiles of a positioning and orientation mechanism such as a casing coupling module 450 set into the casing 412, as shown in FIG. 12.

For directing various tools and equipment into a lateral branch bore from the main wellbore, a diverter member 454 (which is retrievable) including orienting keys 456 fits into the main production bore 438 of the lateral branch template 418 and defines a tapered diverter surface 458 that is oriented to divert or deflect a tool being run through the main production bore 438 laterally through the casing window 424 and into the lateral branch bore 426. Tools and equipment that may be diverted into the lateral branch bore 426 include the lateral branch connector 428, the lateral branch liner 430, and other equipment. Other types of junction or branch mechanisms may be employed in other embodiments.

A lower body structure 457 (FIG. 11) of the diverter member 454 is rotationally adjustable relative to the tapered diverter surface 458 to permit selective orientation of the tool being diverted along a selected azimuth. Selective orienting keys 456 of the diverter member 454 are seated within respective profiles of the lateral branch template 418 while the upper portion 459 of the diverter member 454 is rotationally adjusted relative thereto for selectively orienting the tapered diverter surface 458. The lateral branch template 418 further provides a landing profile to receive the diverter member 454.

Isolating packers 460 and 462 (FIG. 9) are interconnected with the lateral branch template 418 and are positioned above and below the casing window 424 to isolate the template annular space respectively above and below the casing window 424.

The lateral branch template 418 is located and secured in the main wellbore 422 by fitting into the casing coupling module 450 (FIG. 12) to position accurately the template in depth and orientation with respect to the casing window 424. The lateral branch template 118 provides a polished bore receptacle for eventual tie back at its upper portion and is provided with a threaded connection at its lower portion. The lateral branch template 418 has adjustment components that may be integrated into, or attached to, the lateral branch template 418 that allow for adjusting the position and orientation of the lateral branch template 418 with respect to the casing window 424. The main production bore 438 allows fluid and production equipment to pass through the lateral branch template 418 so access in branches located below the junction is still allowed for completion or intervention work after the lateral branch template 418 has been set. A lateral opening 442 in the lateral branch template 418 provides space for passing the lateral branch liner 430 (FIG. 7), for locating the lateral branch connector 428, and for passing other components into the lateral branch bore 426.

The lateral branch template 418 has a landing profile and a latching mechanism to support and retain the lateral branch connector 428 so it is positively coupled to the casing coupling module 450 (FIG. 12). The lateral branch template 418 incorporates an interlocking feature that positions the lateral branch connector 428 to provide support against forces that may be induced by shifting of the surrounding formation or by the fluid pressure of produced fluid in the junction.

In accordance with some embodiments, the upper and/or lower ends of the lateral branch connector 428 may be equipped with electrical connectors and hydraulic ports so electrical and hydraulic fluid connections can be achieved with the lateral branch bore 426 to carry electric and hydraulic power and signal lines through the connector 428 into the lateral branch bore 426. Electrical connections can take the form of inductive coupler connections. Alternatively, other forms of electromagnetic connections can also be used.

Figure 13:
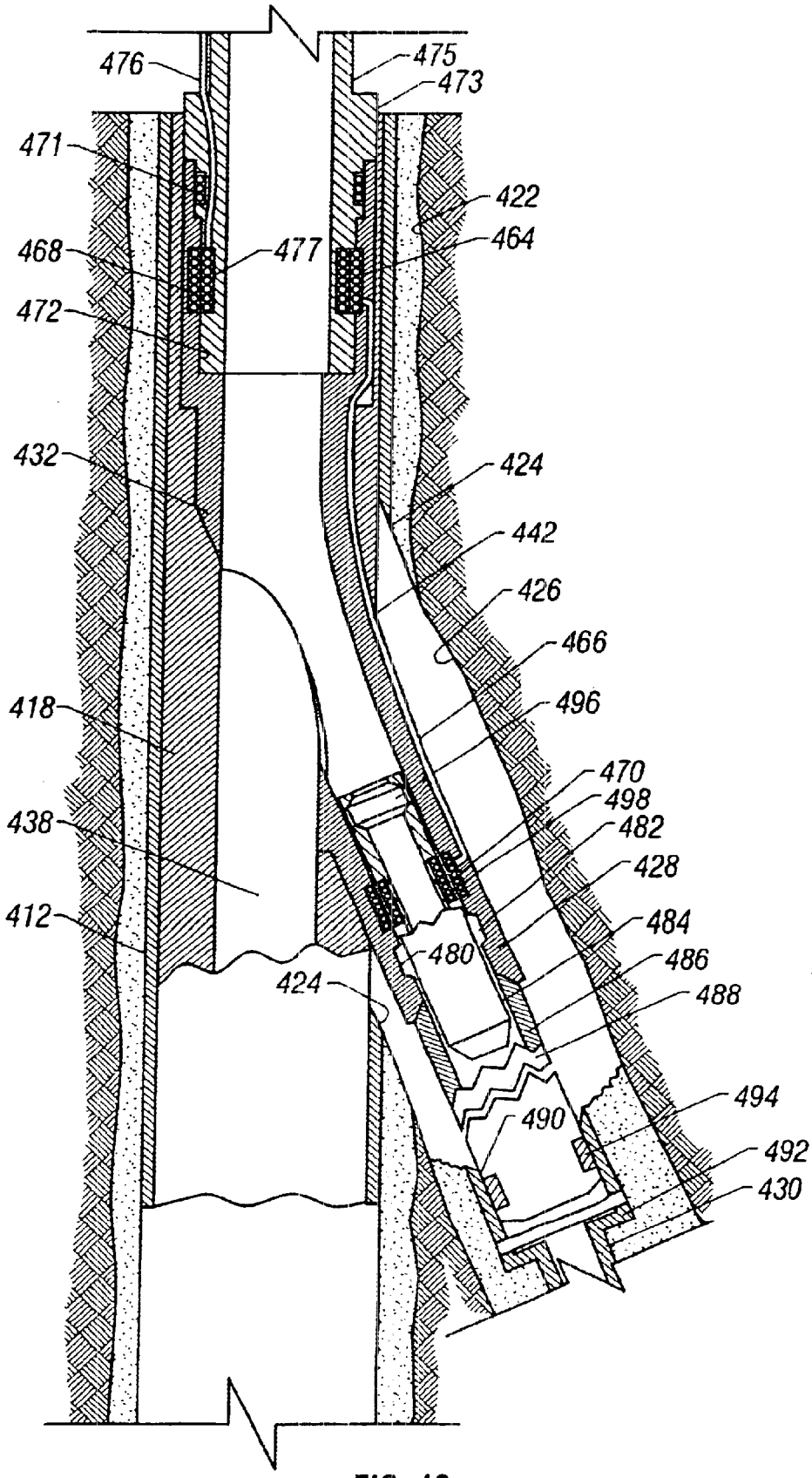
FIG. 13 is a fragmentary sectional view of the components shown in FIG. 12 and in addition a portion of a production tubing in the main bore and a control and/or monitoring module in the lateral branch, each of the production tubing and control and/or monitoring module including an inductive coupler portion to communicate electrical power and signaling.

As shown in FIGS. 12 and 13, the lateral branch connector 428 has a power connector mechanism 464 that includes an electrical connector and, optionally, a hydraulic connector. Further, a tubing encapsulated cable or permanent downhole cable 466 may extend from the power connector mechanism 464 substantially the length of the lateral branch connector 428 to carry electrical power and signaling into the lateral branch bore 426. In accordance with one embodiment, two inductive coupler portions 468 and 470 are provided to couple electrical power from the main bore 422 to the lateral branch bore 426. The inductive coupler portion 468 (referred to as the main bore inductive coupler portion) is located within a polished bore receptacle 472 having an upper polished bore section 474 that is engageable by a seal 471 (FIG. 12) located at the lower end of a section of production tubing 475.

The tubing encapsulated cable 466 is connected between the main bore inductive coupler portion 468 and the lateral branch inductive coupler portion 470. Electrical power and signaling received at one of the inductive coupler portions 468 and 470 is communicated to the other over the cable 466 in the lateral branch connector 428.

As shown in FIG. 13, the main bore inductive coupler portion 468 derives its electrical energy from a power supply coupled through an electrical cable 476 that extends outside the tubing 475, such as in the casing-tubing annulus. Alternatively, the electrical cable 476 may extend along the housing of the tubing 475. The control line 476 may also incorporate hydraulic supply and control lines for the purpose of hydraulically controlling and operating downhole equipment of the main or branch bores of the well.

When an upper junction production connection 473 of the lower part of the production tubing 475 is seated within the bore receptacle 472, an inductive coupler portion 477 attached in the housing of the tubing 475 is positioned next to the main bore inductive coupler portion 468 in the power connector mechanism 468 of the lateral branch connector 464. As a result, the inductive coupler portions 468 and 477 form an inductive coupler assembly through which electrical power and signals can be communicated. Once the upper junction production connection 473 is properly positioned, the power supply and electrical signal connection mechanism is completed in the main bore part of the lateral branch connector 428.

In the lateral branch bore 426, the lateral branch connector 428 defines an internal latching profile 480 that receives the external latching elements 482 of a lateral production monitoring and/or flow control module 484. The module 484 can be one of many types of devices, such as an electrically operable flow control valve, an electrically adjustable flow control and choke device, a pressure or flow monitoring device, a monitoring device for sensing or measuring various branch well fluid parameters, a combination of the above, or other devices. The module 484 is provided with an inductive coupler portion 498 that is in inductive registry with the lateral branch inductive coupler portion 470 when the module 484 is properly seated and latched by the latching elements 482.

In another arrangement, the monitoring or control module 484 may be located further downhole in the lateral branch bore 426. In that arrangement, an electrical cable may be attached to the inductive coupler portion 498. The lateral production monitoring and/or flow control module 484 is provided at its upper end with a module setting and retrieving feature 496 that permits running and retrieving of the module 484 by use of conventional running tools.

The lateral branch connector 428 is connected by a threaded connection 486 to a lateral connector tube 488 having an end portion 490 that is received within a lateral branch connector receptacle 492 of the lateral branch liner 430. The lateral connector tube 488 is sealed in the lateral branch liner 430 by a seal 494.

Figure 15:
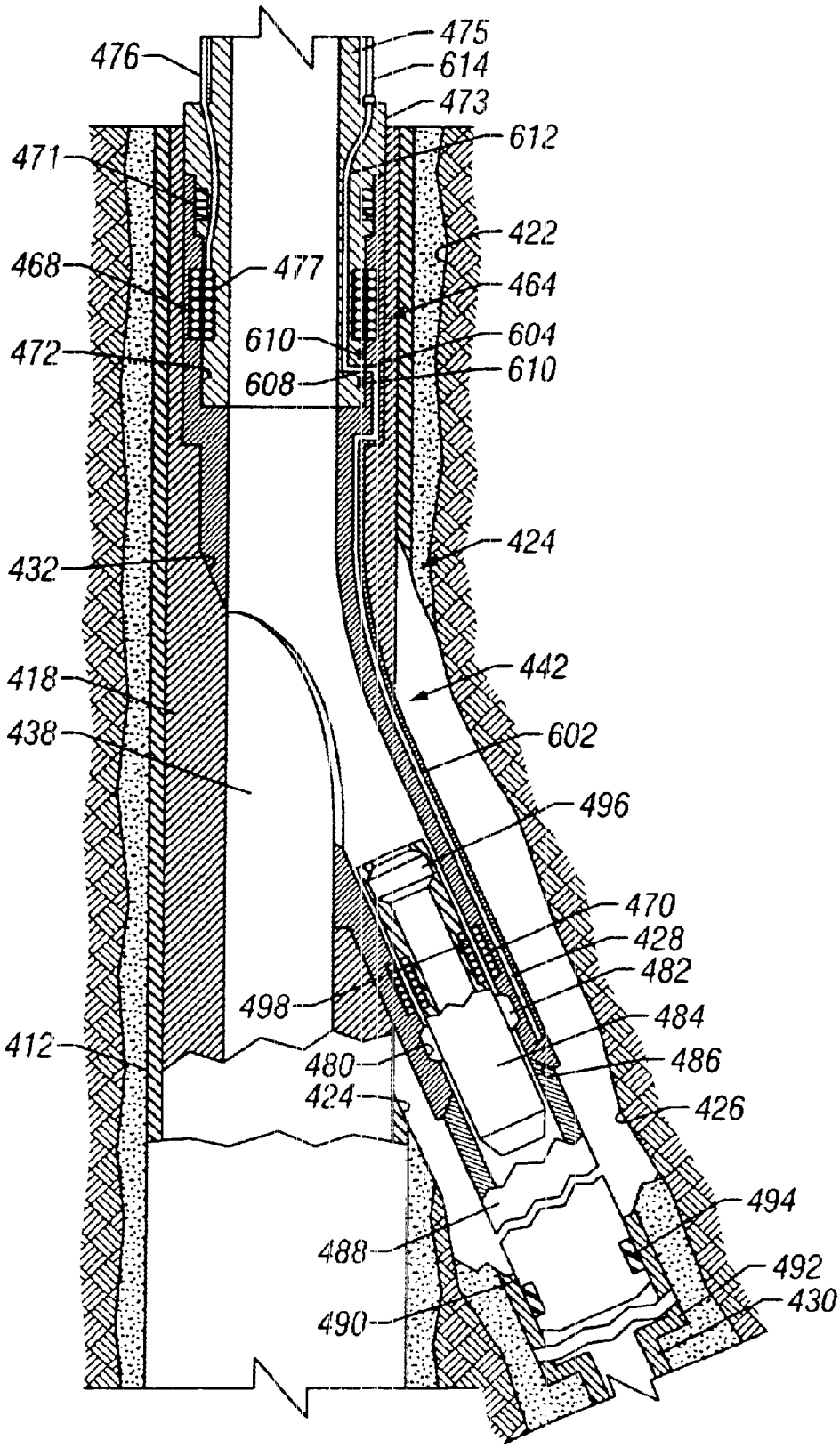
FIG. 15 is a fragmentary sectional view of the components shown in FIG. 13 in a different phase.

Referring to FIG. 15, in addition to the electrical cable 466 extending through the lateral branch connector 428, an optional hydraulic control line 602 can also extend through the lateral branch connector 428. The longitudinal sectional view shown in FIG. 15 is slightly rotated with respect to the sectional view shown in FIG. 13. Thus, in the sectional view of FIG. 15, the hydraulic control line 602 is visible, but the cable 466 is not. One of the concerns associated with inductive couplers is they have relatively poor efficiency. As a result, a hydraulic control line may be desirable as a backup for the inductive coupler mechanism. Also, aside from the use of the hydraulic control line as a backup, there may be hydraulically controlled devices in the lateral branch which can be controlled by hydraulic pressure in the hydraulic control line 602.

At its upper end, the hydraulic control line 602 extends to a side port 604 that is in communication with the inside of the lateral branch connector 428. When the production tubing 475 is stabbed into a seal bore of the lateral branch connector 428, the side port 604 in the lateral branch connector 428 is designed to mate with a corresponding side port 608 that is exposed to the outside of the production tubing 475. Seals 610 are provided above and below the side port 608 in the production tubing 475. The seals 610 when engaged with the inner surface of the seal bore provides a sealed connection. The side port 608 communicates with a conduit 612 that extends longitudinally up the housing of the production tubing 475. The conduit 612 is engaged to a control line 614 (or alternatively, to the control line 476).

Thus, as shown in FIG. 15, hydraulic pressure communicated down the hydraulic control line 614 is communicated through the conduit 612 in the production tubing 475 to the side port 608 of the production tubing. The hydraulic pressure is in turn communicated through the side port 604 of the lateral branch connector 428, which is then further communicated down the hydraulic control line 602 to a location in the lateral branch.

Figure 14:
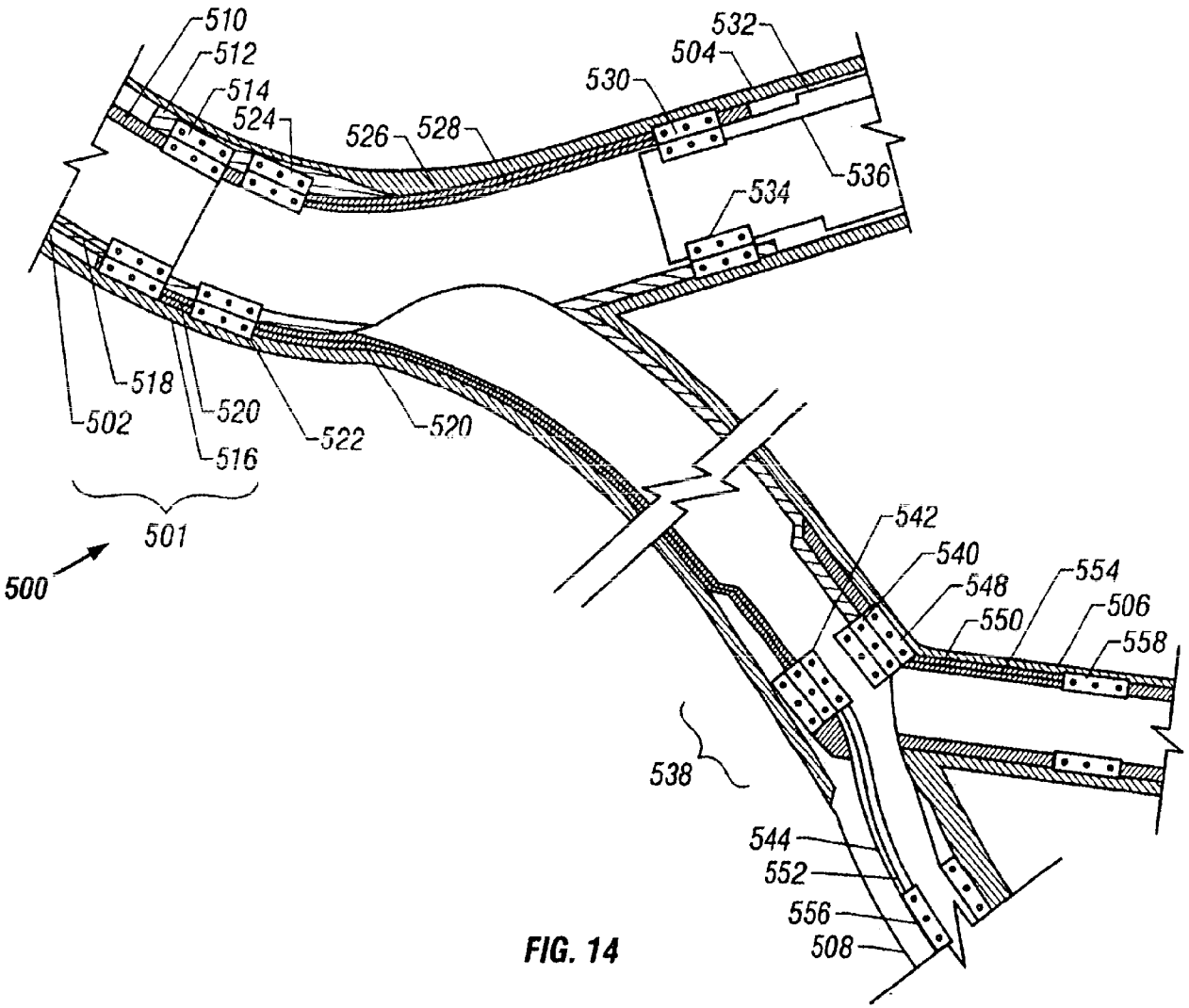
FIG. 14 illustrates completion equipment for communicating electrical power and signaling to devices in lateral branches of a multilateral well.

Referring to FIG. 14, in accordance with another embodiment, a completion string 500 includes mechanisms for carrying electrical power and signaling in a main bore 502 as well as in multiple lateral branch bores 504, 506 and 508. A production tubing 510 extending in the main bore 502 from the surface is received in a first lateral branch template 512. The end of the production tubing 510 includes an inductive coupler portion 514 that is adapted to communicate with another inductive coupler portion 516 attached in the housing of the lateral branch template 512. The production tubing inductive coupler portion 514 is connected to an electrical cable 518 that extends to a power and telemetry source elsewhere in the main bore 502 or at the well surface. Power and signaling magnetically coupled from the production tubing inductive coupler portion 514 to the lateral branch template inductive coupler portion 516 is transmitted over one or more conductors 520 to a second inductive coupler portion 522 in the lateral branch template 512. The second inductive coupler portion 522 is adapted to be positioned proximal an inductive coupler portion 524 attached to a lateral branch connector 526. The lateral branch connector 526 is diverted into the lateral branch bore 504. The lateral branch connector inductive coupler portion 524 is connected by one or more conductors 528 to another inductive coupler portion 530 at the other end of the lateral branch connector 526. In the lateral branch bore 504, the inductive coupler portion 530 is placed in the proximity of a lateral branch tool inductive coupler portion 534. The received power and signaling may be communicated down one or more conductors 536 to other devices in the lateral branch bore 504.

In the main bore 502, the one or more electrical conductors 520 also extend in the template 512 down to a second connector mechanism 538 that is adapted to couple electrical power and signaling to devices in lateral branch bores 506 and 508. The one or more electrical conductors 520 extend to a lower inductive coupler portion 540 in the template 512, which is positioned proximal an inductive coupler portion 542 attached to a lateral branch connector 544 leading into the lateral branch bore 508. The inductive coupler portion 540 attached to the template 512 is also placed proximal another inductive coupler portion 548 that is attached to a lateral branch connector 550 that leads into the other lateral branch bore 506.

As shown, each of the inductive coupler portions 542 and 548 are connected by respective electrical conductors 552 and 554 in lateral branch connectors 544 and 550 to respective inductive coupler portions 556 and 558 in the lateral branch bores 508 and 506. The scheme illustrated in FIG. 14 can be modified to communicate electrical power and signaling to even more lateral branch bores that may be part of the well. Other arrangements of the inductive coupler portions may also be possible in further embodiments.

Thus, by using inductive coupler assemblies to electrically provide power and signals from the main bore to one or more lateral branch bores, wired connections can be avoided. Eliminating wired connections may reduce the complexity of installing completion equipment in a multilateral well that includes electrical control or monitoring devices in lateral branches.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus for use in a wellbore, comprising:

a liner section having a wall;

an electrical device for positioning outside the liner section in an annular region defined by an outer surface of the liner section and the wellbore;

a first inductive coupler portion provided in a cavity in the wall of the liner section and electrically connected to the electrical device; and a second inductive coupler portion positioned inside the liner section to communicate electrical signaling with the first inductive coupler portion.

2. The apparatus of claim 1, further comprising an electrical cable connected to the second inductive coupler portion for connection to a power and telemetry source.

3. The apparatus of claim 1, wherein the electrical device comprises a resistivity electrode.

4. The apparatus of claim 1, wherein the liner section comprises a casing section.

5. The apparatus of claim 1, wherein the electrical device comprises a control module.

6. The apparatus of claim 5, wherein the electrical device further comprises a monitoring device.

7. The apparatus of claim 1, wherein the liner section comprises a coupling module adapted to be connected to at least another liner portion.

8. The apparatus of claim 1, further comprising a production tubing section, the second inductive coupler portion attached to the production tubing section.

9. The apparatus of claim 8, wherein the liner section comprises a casing section.

10. The apparatus of claim 1, wherein the liner section comprises a locating member, and the apparatus further comprises a tool including a locating mating member to engage the liner section locating member to position the first and second inductive coupler portions in proximity to each other.

11. The apparatus of claim 1, wherein the liner section comprises an orientation member, and the apparatus further comprises a tool including a mating orientation member to engage the liner section orientation member to orient the second inductive coupler portion relative to the first inductive coupler portion.

12. The apparatus of claim 1, wherein the liner section comprises a first liner section, the apparatus further comprising a second liner section below the first liner section, wherein the first and second inductive coupler portions are in the wellbore above the second liner section.

13. The apparatus of claim 1, further comprising a protective sleeve to cover the cavity to protect the first inductive coupler portion.

14. The apparatus of claim 1, further comprising a tool to carry the second inductive coupler portion, the tool to position the second inductive coupler portion in the wellbore.

15. A method of communicating with an electrical device in a wellbore, having a liner section, the liner section having a wall, the method comprising;

providing an inductive coupler mechanism, the inductive coupler mechanism comprising a first part inside the liner section and a second part provided in a cavity of the wall of the liner section and electrically connected to the electrical device that is mounted outside the liner section in an annular region defined by an outer surface of the liner section and the wellbore; and communicating electrical signaling between the first and second parts of the inductive coupler mechanism to communicate with the electrical device.

16. The method of claim 15, further comprising retrieving measurements made by the electrical device through the inductive coupler mechanism.

17. The method of claim 15, further comprising communicating power between the first and second parts of the inductive coupler mechanism.

18. The method of claim 15, wherein the liner section comprises a first liner section, the method further comprising:

providing a second liner section below the first liner section; and providing the inductive coupler mechanism in the wellbore above the second liner section.

* * * * *